US011371754B2

(12) United States Patent
Xu et al.

(10) Patent No.: US 11,371,754 B2
(45) Date of Patent: Jun. 28, 2022

(54) GM CRYOCOOLER

(71) Applicant: SUMITOMO HEAVY INDUSTRIES, LTD., Tokyo (JP)

(72) Inventors: Mingyao Xu, Tokyo (JP); Qian Bao, Tokyo (JP); Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 504 days.

(21) Appl. No.: 16/203,242

(22) Filed: Nov. 28, 2018

(65) Prior Publication Data

US 2019/0093927 A1 Mar. 28, 2019

Related U.S. Application Data

(63) Continuation of application No. PCT/JP2017/019581, filed on May 25, 2017.

(30) Foreign Application Priority Data

Jun. 2, 2016 (JP) ..... JP2016-110946

(51) Int. Cl.
*F25B 9/10* (2006.01)
*F25B 9/14* (2006.01)

(52) U.S. Cl.
CPC ..... *F25B 9/14* (2013.01); *F25B 9/10* (2013.01); *F25B 2309/002* (2013.01); *F25B 2309/006* (2013.01); *F25B 2309/14* (2013.01)

(58) Field of Classification Search
CPC ..... F25B 9/14; F25B 9/10; F25B 2309/002; F25B 2309/006; F25B 2309/14;
(Continued)

(56) References Cited

U.S. PATENT DOCUMENTS 3,552,120 A * 1/1971 Beale ..... F25B 9/14 60/525
3,782,859 A * 1/1974 Schuman ..... F01B 11/00 417/207
(Continued)

FOREIGN PATENT DOCUMENTS

JP S53-054850 A 5/1978
JP H03-018912 Y2 4/1991
(Continued)

OTHER PUBLICATIONS

International Search Report issued in Application No. PCT/JP2017/019581, dated Aug. 22, 2017.

*Primary Examiner* — Jianying C Atkisson
*Assistant Examiner* — Erik Mendoza-Wilkenfel
(74) *Attorney, Agent, or Firm* — Michael Best & Friedrich LLP

(57) ABSTRACT

A GM cryocooler includes a valve portion which defines a valve group including a first intake valve, a first exhaust valve, and a pressure equalizing valve. A valve rotor of the valve portion includes a rotor plane which is in surface contact with a stator plane of a valve stator. The valve rotor includes a high pressure flow path which is open to the rotor plane to form a portion of the first intake valve, a low pressure flow path which is open to the rotor plane to form a portion of the first exhaust valve, and a pressure equalization flow path which is open to the rotor plane to form a portion of the pressure equalizing valve, and the high pressure flow path, the low pressure flow path, and the pressure equalization flow path are circumferentially arranged around a valve rotation axis on the rotor plane.

18 Claims, 6 Drawing Sheets

(58) Field of Classification Search
CPC ..... F25B 2309/1406; F25B 2309/1418; F25B 9/00; F25B 9/145
See application file for complete search history.

(56) References Cited

U.S. PATENT DOCUMENTS

| | | | | |
|---|---|---|---|---|
| 6,460,349 | B1 * | 10/2002 | Kawano | F16K 11/074 251/129.11 |
| 9,551,513 | B2 * | 1/2017 | Yates | F25B 9/145 |
| 9,644,867 | B2 * | 5/2017 | Xu | F25B 9/145 |
| 2011/0094244 | A1 * | 4/2011 | Xu | F25B 9/145 62/6 |
| 2013/0219923 | A1 * | 8/2013 | Mizuno | F25B 9/14 62/6 |

FOREIGN PATENT DOCUMENTS

| | | | |
|---|---|---|---|
| JP | H05-312426 | A | 11/1993 |
| JP | 2001-012817 | A | 1/2001 |
| JP | 2002-228289 | A | 8/2002 |
| JP | 2004-092406 | A | 3/2004 |
| JP | 2013-174411 | A | 9/2013 |

* cited by examiner

72a

72b

72

72b

72

GM CRYOCOOLER

RELATED APPLICATIONS

Priority is claimed to Japanese Patent Application No. 2016-110946, filed Jun. 2, 2016, and International Patent Application No. PCT/JP2017/19581, the entire content of each of which is incorporated herein by reference.

BACKGROUND

Technical Field

A certain embodiment of the present invention relates to a Gifford-McMahon (GM) cryocooler.

Description of Related Art

A GM cryocooler which is a representative example of a cryocooler generates an extremely low temperature using a GM cycle. Accordingly, the GM cryocooler is configured such that periodic pressure fluctuation in an expansion space configured of intake of a working gas into the expansion space, adiabatic expansion of the working gas, and exhaust of the working gas, and periodic volume variation of the expansion space due to reciprocation of a displacer are appropriately synchronized.

SUMMARY

According to an embodiment of the present invention, there is provided a GM cryocooler including: a first cold head which includes a first displacer and a first cylinder which forms a first gas chamber between the first displacer and the first cylinder; a second cold head which includes a second displacer and a second cylinder which forms a second gas chamber between the second displacer and the second cylinder; and a valve portion which defines a valve group including a first intake valve configured to perform intake of the first gas chamber, a first exhaust valve configured to perform exhaust of the first gas chamber, and a pressure equalizing valve configured to perform pressure equalization between the first gas chamber and the second gas chamber, the valve portion including a valve stator which has a stator plane perpendicular to a valve rotation axis and a valve rotor which has a rotor plane perpendicular to the valve rotation axis to be in surface contact with the stator plane and is rotatable around the valve rotation axis with respect to the valve stator, in which the valve rotor includes a high pressure flow path which is open to the rotor plane to form a portion of the first intake valve, a low pressure flow path which is open to the rotor plane to forma portion of the first exhaust valve, and a pressure equalization flow path which is open to the rotor plane to form a portion of the pressure equalizing valve, and the high pressure flow, the low pressure flow path, and the pressure equalization flow path are circumferentially arranged around the valve rotation axis on the rotor plane.

DETAILED DESCRIPTION

Figure 1:
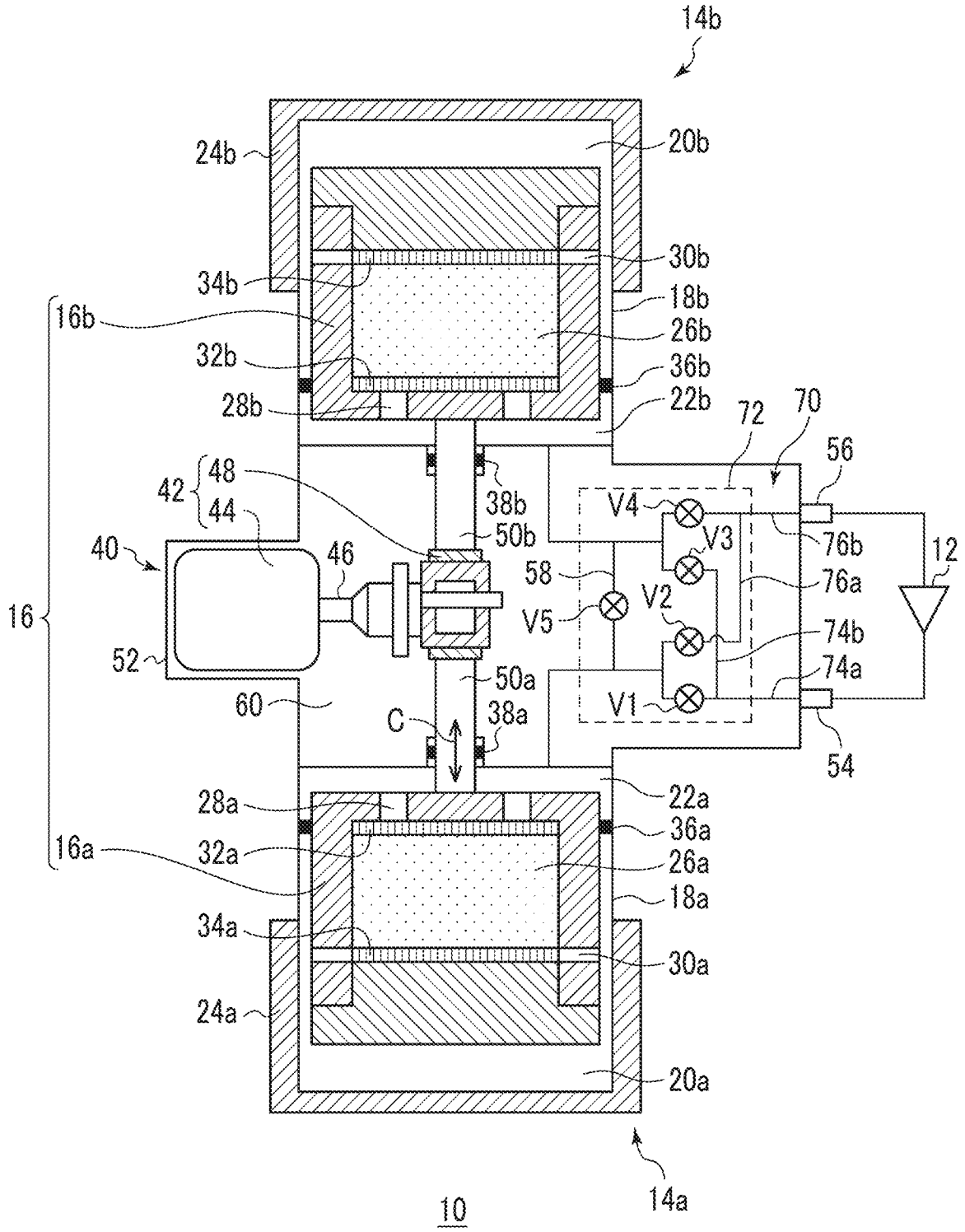
FIG. 1 is a sectional view schematically showing a GM cryocooler according an embodiment.

A general basic configuration of a GM cryocooler includes one compressor and one expander (that is, a combination between one displacer and a drive portion thereof). As a configuration example derived from the basic configuration, a cryocooler is suggested which includes two displacers which are disposed to one displacer drive portion in parallel and in which intake operations to expansion spaces corresponding to the two displacers are alternately performed. The alternate intake operations of the two expanders decrease a pressure fluctuation in the compressor, and improve efficiency of the compressor. Accordingly, this contributes efficiency improvement of the cryocooler. In addition, the two expanders are connected to each other by a pressure equalizing pipe such that a high pressure refrigerant gas can be supplied from one expander to the other expander. This also contributes to the efficiency of the cryocooler. In the above-described cryocooler, a flow path switching valve and a pressure equalizing valve are separately provided, and a pressure equalization step is performed after an intake step (or exhaust step) is completed. The intake step, the exhaust step, and the pressure equalization step are separated from each other and do not overlap each other in time.

It is desirable to provide an improved valve structure in a GM cryocooler having a plurality of displacers.

According to the present invention, it is possible to provide an improved valve structure in a GM cryocooler having a plurality of displacers.

Hereinafter, an embodiment of the present invention will be described in detail with reference to the drawings. In addition, in descriptions, the same reference numerals are assigned to the same elements, and overlapping descriptions thereof are appropriately omitted. Moreover, configurations described below are exemplified, and do not limit the scope of the present invention.

Figure 2:
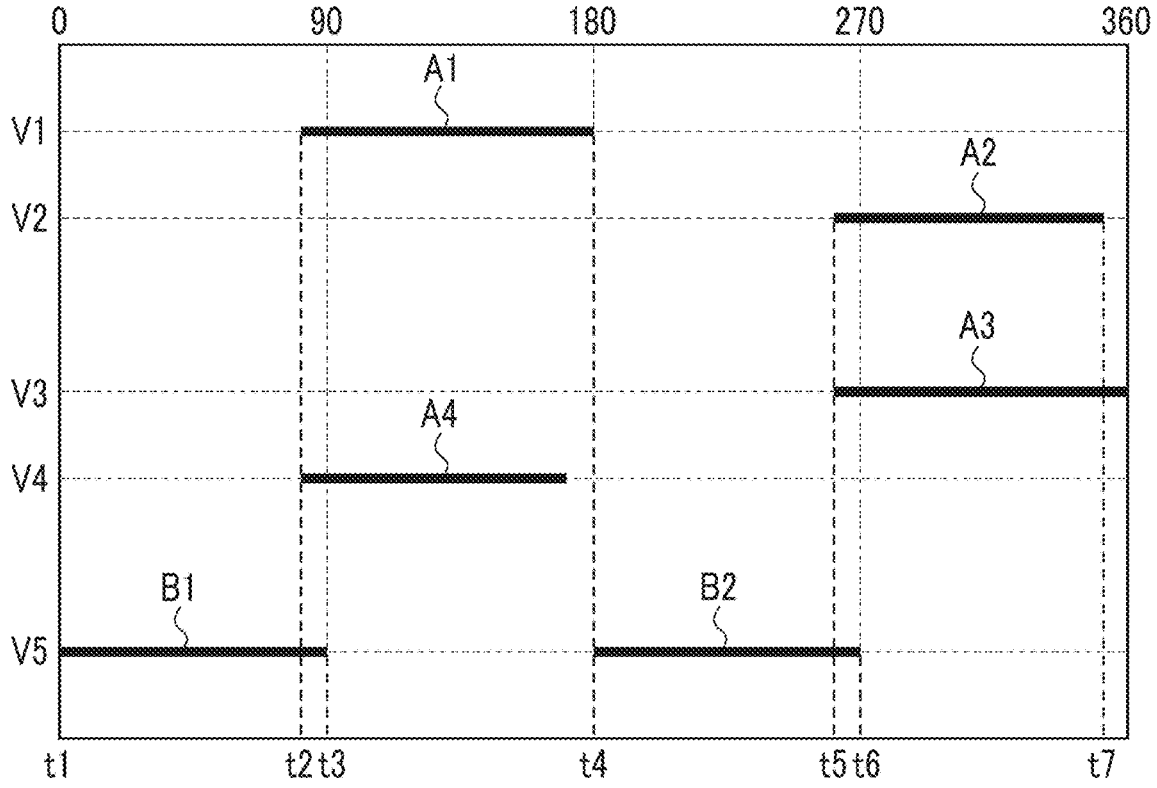
FIG. 2 is a graph exemplifying a valve timing of the GM cryocooler shown in FIG. 1.

FIG. 1 is a sectional view schematically showing a GM cryocooler 10 according an embodiment. FIG. 2 is a graph exemplifying a valve timing of the GM cryocooler 10 shown in FIG. 1.

The GM cryocooler 10 includes a compressor 12 which compresses a working gas (for example, helium gas), and a plurality of cold heads which are cooled by adiabatic expansion of the working gas. The cold head is referred to as an expander. As described in detail below, the compressor 12 supplies a high pressure working gas to the cold heads. A regenerator which pre-cools the working gas is provided in the cold head. The pre-cooled working gas is cooled by expansion in the cold head again. The working gas is recovered to the compressor 12 through the regenerator. When the working gas passes through the regenerator, the regenerator is cooled. The compressor 12 compresses the recovered working gas, and supplies the compressed working gas to the expander again.

As is known, the working gas having a first high pressure is supplied from a discharge port of the compressor 12 to the cold head. The pressure of the working gas decreases from the first high pressure to a second high pressure which is lower than the first high pressure by adiabatic expansion in the cold head. The working gas having the second high pressure is recovered from the cold head to a suction port of the compressor 12. The compressor 12 compresses the recovered working gas having the second high pressure. In this way, the pressure of the working gas increases to the first high pressure again. In general, the first high pressure and the second high pressure are considerably higher than the atmosphere pressure. For convenience of descriptions, the first high pressure and the second high pressure are simply referred to as a high pressure and a lower pressure, respectively. In general, for example, the high pressure is 2 to 3 MPa, and the low pressure is 0.5 to 1.5 MPa. For example, a difference between the high pressure and the low pressure is approximately 1.2 to 2 MPa.

The GM cryocooler 10 includes a first cold head 14*a* and a second cold head 14*b* which are disposed so as to face each other. In addition, the GM cryocooler 10 includes a common drive mechanism 40 for the first cold head 14*a* and the second cold head 14*b*. The first cold head 14*a* is disposed on one side with respect to the common drive mechanism 40, and the second cold head 14*b* is disposed on the other side with respect to the common drive mechanism 40. In addition, the GM cryocooler 10 includes a working gas circuit 70 which connects the compressor 12 to the first cold head 14*a* and the second cold head 14*b*.

The first cold head 14*a* is a single staged cold head. The first cold head 14*a* includes a first displacer 16*a* which can axially reciprocate, and a first cylinder 18*a* which accommodates the first displacer 16*a*. The axial reciprocation of the first displacer 16*a* is guided by the first cylinder 18*a*. In general, each of the first displacer 16*a* and the first cylinder 18*a* is a cylindrical member which axially extends, and an inner diameter of the first cylinder 18*a* is slightly greater than an outer diameter of the first displacer 16*a*. Here, the axial direction is an upward-downward direction in FIG. 1 (arrow C).

A first expansion chamber 20*a* is formed between the first displacer 16*a* and the first cylinder 18*a* on one end in the axial direction, and a first room-temperature chamber 22*a* is formed between the first displacer 16*a* and the first cylinder 18*a* on the other end in the axial direction. The first room-temperature chamber 22*a* is positioned near the common drive mechanism 40, and the first expansion chamber 20*a* is positioned far from the common drive mechanism 40. This means that the first room-temperature chamber 22*a* is formed on a proximal end of the first cold head 14*a* and the first expansion chamber 20*a* is formed on a distal end of the first cold head 14*a*. A first cooling stage 24*a*, which is fixed to the first cylinder 18*a* so as to enclose the first expansion chamber 20*a*, is provided on the distal end of the first cold head 14*a*.

When the first displacer 16*a* axially moves, the first expansion chamber 20*a* and the first room-temperature chamber 22*a* complementarily increase and decrease the volume. That is, when the first displacer 16*a* moves upward, the first expansion chamber 20*a* is widened, and the first room-temperature chamber 22*a* is narrowed, and vice versa.

The first displacer 16*a* includes a first regenerator 26*a* which is built therein. The first displacer 16*a* includes a first inlet flow path 28*a*, which allows the first regenerator 26*a* to communicate with the first room-temperature chamber 22*a*, on an upper lid portion of the first displacer 16*a*. In addition, the first displacer 16*a* includes a first outlet flow path 30*a*, which allows the first regenerator 26*a* to communicate with the first expansion chamber 20*a*, on the tubular portion of the first displacer 16*a*. Alternatively, the first outlet flow path 30*a* may be provided on a lower lid portion of the first displacer 16*a*. Moreover, the first displacer 16*a* includes a first inlet flow-straightener 32*a* which is in inner-contact with the upper lid portion, and a first outlet flow-straightener 34*a* which is in inner-contact with the lower lid portion. The first regenerator 26*a* is interposed between the pair of flow-straighteners.

The first cold head 14*a* includes a first seal portion 36*a* which blocks a clearance formed between the first cylinder 18*a* and the first displacer 16*a*. For example, the first seal portion 36*a* is a slipper seal, and is mounted on the tubular portion or the upper lid portion of the first displacer 16*a*.

In this way, the first seal portion 36*a* is positioned near the common drive mechanism 40, and the first outlet flow path 30*a* is away from the common drive mechanism 40 and is positioned near the first cooling stage 24*a*. In other words, the first seal portion 36*a* is attached to a proximal portion of the first displacer 16*a*, and the above-described first outlet flow path 30*a* is formed in a distal portion of the first displacer 16*a*.

The working gas flows from the first room-temperature chamber 22*a* into the first regenerator 26*a* through the first inlet flow path 28*a*. More specifically, the working gas flows from the first inlet flow path 28*a* into the first regenerator 26*a* through the first inlet flow-straightener 32*a*. The working gas flows from the first regenerator 26*a* into the first expansion chamber 20*a* via the first outlet flow-straightener 34*a* and the first outlet flow path 30*a*. The working gas goes through a reverse pathway with respect to the above-described pathway when the working gas is returned from the first expansion chamber 20*a* to the first room-temperature chamber 22*a*. That is, the working gas is returned from the first expansion chamber 20*a* to the first room-temperature chamber 22*a* through the first outlet flow path 30*a*, the first regenerator 26*a*, and the first inlet flow path 28*a*. The working gas, which bypasses the first regenerator 26*a* and flows into the clearance, is interrupted by the first seal portion 36*a*.

As described above, the second cold head 14*b* is disposed on the side opposite to the first cold head 14*a* with respect to the common drive mechanism 40. Except for this, the configuration of the second cold head 14*b* is similar to that of the first cold head 14*a*. Accordingly, similarly to the first cold head 14*a*, the second cold head 14*b* is a single staged cold head, and has the shape and size similar to those of the first cold head 14*a*.

The second cold head 14*b* includes a second displacer 16*b* which is disposed coaxially with the first displacer 16*a* and can axially reciprocate integrally with the first displacer 16*a*, and a second cylinder 18*b* which accommodates the second displacer 16*b*. The axial reciprocation of the second displacer 16*b* is guided by the second cylinder 18*b*. In general, each of the second displacer 16*b* and the second cylinder 18*b* is a cylindrical member which axially extends, and an inner diameter of the second cylinder 18*b* is slightly greater than an outer diameter of the second displacer 16*b*.

A second expansion chamber 20*b* is formed between the second displacer 16*b* and the second cylinder 18*b* on one end in the axial direction, and a second room-temperature chamber 22*b* is formed between the second displacer 16*b* and the second cylinder 18*b* on the other end in the axial direction. The second room-temperature chamber 22*b* is positioned near the common drive mechanism 40, and the second expansion chamber 20*b* is positioned far from the common drive mechanism 40. This means that the second room-temperature chamber 22*b* is formed on a proximal end of the second cold head 14*b* and the second expansion chamber 20*b* is formed on a distal end of the second cold head 14*b*. A second cooling stage 24*b*, which is fixed to the second cylinder 18*b* so as to enclose the second expansion chamber 20*b*, is provided on the distal end of the second cold head 14*b*.

When the second displacer 16*b* axially moves, the second expansion chamber 20*b* and the second room-temperature chamber 22*b* complementarily increase and decrease the volume. That is, when the second displacer 16*b* moves downward, the second expansion chamber 20*b* is widened, and the second room-temperature chamber 22*b* is narrowed, and vice versa.

The second displacer 16*b* includes a second regenerator 26*b* which is built therein. The second displacer 16*b* includes a second inlet flow path 28*b*, which allows the second regenerator 26*b* to communicate with the second room-temperature chamber 22*b*, on the upper lid portion of the second displacer 16*b*. In addition, the second displacer 16*b* includes a second outlet flow path 30*b*, which allows the second regenerator 26*b* to communicate with the second expansion chamber 20*b*, on the tubular portion of the second displacer 16*b*. Alternatively, the second outlet flow path 30*b* may be provided on the lower lid portion of the second displacer 16*b*. Moreover, the second displacer 16*b* includes a second inlet flow-straightener 32*b* which is in inner-contact with the upper lid portion, and a second outlet flow-straightener 34*b* which is in inner-contact with the lower lid portion. The second regenerator 26*b* is interposed between the pair of flow-straighteners.

The second cold head 14*b* includes a second seal portion 36*b* which blocks a clearance formed between the second cylinder 18*b* and the second displacer 16*b*. For example, the second seal portion 36*b* is a slipper seal, and is mounted on the tubular portion or the upper lid portion of the second displacer 16*b*.

In this way, the second seal portion 36*b* is positioned near the common drive mechanism 40, and the second outlet flow path 30*b* is away from the common drive mechanism 40 and is positioned near the second cooling stage 24*b*. In other words, the second seal portion 36*b* is attached to a proximal portion of the second displacer 16*b*, and the above-described second outlet flow path 30*b* is formed in the distal portion of the second displacer 16*b*.

The working gas flows from the second room-temperature chamber 22*b* into the second regenerator 26*b* through the second inlet flow path 28*b*. More specifically, the working gas flows from the second inlet flow path 28*b* into the second regenerator 26*b* through the second inlet flow-straightener 32*b*. The working gas flows from the second regenerator 26*b* into the second expansion chamber 20*b* via the second outlet flow-straightener 34*b* and the second outlet flow path 30*b*. The working gas goes through a reverse pathway with respect to the above-described pathway when the working gas is returned from the second expansion chamber 20*b* to the second room-temperature chamber 22*b*. That is, the working gas is returned from the second expansion chamber 20*b* to the second room-temperature chamber 22*b* through the second outlet flow path 30*b*, the second regenerator 26*b*, and the second inlet flow path 28*b*. The working gas, which bypasses the second regenerator 26*b* and flows into the clearance, is interrupted by the second seal portion 36*b*.

The GM cryocooler 10 is installed in the shown direction in the use site thereof. That is, the first cold head 14*a* is disposed downward in the vertical direction, the second cold head 14*b* is disposed upward in the vertical direction, and thus, the GM cryocooler 10 is installed in a longitudinal direction. The second cold head 14*b* is installed with a posture inverted to that of the first cold head 14*a*. The second expansion chamber 20*b* is disposed upward in the vertical direction in the second cold head 14*b* while the first expansion chamber 20*a* is disposed downward in the vertical direction in the first cold head 14*a*.

Alternatively, the GM cryocooler 10 may be installed in a horizontal direction or in other directions.

In addition, the two cold heads may have configurations different from each other. The first cold head 14*a* may have a size different from that of the second cold head 14*b* so as to have cooling capacity different from that of the second cold head 14*b*.

The cold head is not limited to the single staged cold head. One or both cold heads may be multi-staged cold head (for example, two-staged cold head).

The common drive mechanism 40 includes a reciprocation drive source 42 which drives the axial reciprocation of the first displacer 16*a* and the second displacer 16*b*. The reciprocation drive source 42 includes a rotation drive source 44 (for example, motor) having a rotation output shaft 46, and a Scotch yoke 48 which is connected to the rotation output shaft 46 so as to convert the rotation of the rotation output shaft 46 into axial reciprocation.

The common drive mechanism 40 includes a first connection rod 50*a* and a second connection rod 50*b*. The first connection rod 50*a* axially extends from the reciprocation drive source 42 and connects the reciprocation drive source 42 to the first displacer 16*a*. The second connection rod 50*b* axially extends from the reciprocation drive source 42 on the side opposite to the first connection rod 50*a* and connects the reciprocation drive source 42 to the second displacer 16*b*. The first displacer 16*a*, the first connection rod 50*a*, the second connection rod 50*b*, and the second displacer 16*b* are disposed coaxially with each other.

More specifically, the first connection rod 50*a* axially extends from the Scotch yoke 48 to the first displacer 16*a* and connects the Scotch yoke 48 to the first displacer 16*a*. The first connection rod 50*a* rigidly connects the proximal portion of the first displacer 16*a* to the Scotch yoke 48. The first connection rod 50*a* is supported by a first bearing portion 38*a* so as to be movable in the axial direction. The first bearing portion 38*a* is disposed between the Scotch yoke 48 and the first displacer 16*a*.

The second connection rod 50*b* axially extends from the Scotch yoke 48 to the second displacer 16*b* and connects the Scotch yoke 48 to the second displacer 16*b*. The second connection rod 50*b* rigidly connects the proximal portion of the second displacer 16*b* to the Scotch yoke 48. The second connection rod 50*b* is supported by a second bearing portion 38*b* so as to be movable in the axial direction. The second bearing portion 38*b* is disposed between the Scotch yoke 48 and the second displacer 16*b*.

The reciprocation drive source 42 may include a linear motor which drives the axial reciprocations of the first displacer 16*a* and the second displacer 16*b* instead of the rotation drive source 44, the rotation output shaft 46, and the Scotch yoke 48.

In addition, the GM cryocooler 10 includes a drive mechanism housing (hereinafter, simply referred to as a housing) 52. The first cylinder 18*a* is fixed to one side of the housing 52, and the second cylinder 18*b* is fixed to the other side of the housing 52. The second cylinder 18*b* is disposed coaxially with the first cylinder 18*a*. The first bearing portion 38*a* is disposed at a boundary between the first cylinder 18*a* and the housing 52 or near the boundary. The second bearing portion 38*b* is disposed at a boundary between the second cylinder 18*b* and the housing 52 or near the boundary.

The common drive mechanism 40 is accommodated in the housing 52. The reciprocation drive source 42 and the Scotch yoke 48 are accommodated in the housing 52. Similarly to the Scotch yoke 48, the proximal ends of the first connection rod 50*a* and the second connection rod 50*b* are accommodated in the housing 52. Similarly to the first displacer 16*a* and the second displacer 16*b*, the distal ends of the first connection rod 50*a* and the second connection rod 50*b* are respectively accommodated in the first cylinder 18*a* and the second cylinder 18*b*.

In this way, the common drive mechanism 40 is connected to the first displacer 16*a* and the second displacer 16*b* so as to drive the axial reciprocation of the first displacer 16*a* and the second displacer 16*b*. The first displacer 16*a* and the second displacer 16*b* configure a single displacer connector 16 which is fixedly connected to each other. A relative position of the second displacer 16*b* with respect to the first displacer 16*a* is not changed during the axial reciprocation of the first displacer 16*a* and the second displacer 16*b*.

Accordingly, the axial reciprocation of the first displacer 16*a* and the axial reciprocation of the second displacer 16*b* have phases opposite to each other. When the first displacer 16*a* is positioned at a top dead center (that is, a dead center on the proximal end side), the second displacer 16*b* is positioned at a bottom dead center (that is, a dead center on the distal end side). When the first displacer 16*a* moves from the top dead center to the bottom dead center (that is, when the first displacer 16*a* moves from the proximal end of the first cold head 14*a* to the distal end thereof so as to narrow the first expansion chamber 20*a*), the second displacer 16*b* moves from the bottom dead center to the top dead center (that is, the second displacer 16*b* moves from the distal end of the second cold head 14*b* to the proximal end thereof so as to widen the second expansion chamber 20*b*).

The housing 52 includes a high pressure port 54 for receiving the working gas from the compressor 12 to the working gas circuit 70 and a low pressure port 56 for discharging the working gas from the working gas circuit 70 to the compressor 12. Therefore, the working gas circuit 70 is connected to the discharge port of the compressor 12 through the high pressure port 54. In addition, the working gas circuit 70 is connected to the suction port of the compressor 12 through the low pressure port 56.

An internal space (hereinafter, referred to as a low pressure gas chamber 60) of the housing 52 communicates with the suction port of the compressor 12. Accordingly, the low pressure gas chamber 60 is always maintained at a low pressure. The first bearing portion 38*a* and the second bearing portion 38*b* are configured as seal portions which holds air tightness of the first cylinder 18*a* and the second cylinder 18*b* with respect to the low pressure gas chamber 60. Alternatively, the seal portions may be separately provided from the first bearing portion 38*a* and the second bearing portion 38*b*. In this way, the low pressure gas chamber 60 is isolated from each of the first room-temperature chamber 22*a* and the second room-temperature chamber 22*b*. There is no direct gas flow between the low pressure gas chamber 60 and the first room-temperature chamber 22*a*, and there is no direct gas flow between the low pressure gas chamber 60 and the second room-temperature chamber 22*b*.

The working gas circuit 70 is configured so as to generate a pressure difference between a first gas chamber (that is, first expansion chamber 20*a* and/or first room-temperature chamber 22*a*) and a second gas chamber (that is, second expansion chamber 20*b* and/or second room-temperature chamber 22*b*). The pressure difference acts on the displacer connector 16 so as to assist the common drive mechanism 40. In FIG. 1, when the displacer connector 16 moves downward (that is, when the first (second) displacer 16*a* (16*b*) moves from the top (bottom) dead center to the bottom (top) dead center), the working gas circuit 70 increases the pressure of the second gas chamber with respect to the first gas chamber. In this way, it is possible to assist the downward movement of the displacer connector 16 by the pressure difference between the first gas chamber and the second gas chamber, and vice versa.

The working gas circuit 70 includes a valve portion 72. The valve portion 72 includes a first intake valve V1, a first exhaust valve V2, a second intake valve V3, a second exhaust valve V4, and a pressure equalizing valve V5. The valve portion 72 is accommodated in housing 52. The first intake valve V1 is configured so as to perform the intake of the first gas chamber, and the first exhaust valve V2 is configured so as to perform the exhaust of the first gas chamber. The second intake valve V3 is configured so as to perform the intake of the second gas chamber, and the second exhaust valve V4 is configured so as to perform the exhaust of the second gas chamber. The pressure equalizing valve V5 is configured so as to perform the pressure equalization between the first gas chamber and the second gas chamber.

The valve portion 72 may be a rotary type valve. In this case, the valve portion 72 may be connected to the rotation output shaft 46 so as to be rotationally driven by the rotation of a rotation drive source 44. The rotary valve may be configured to determine a valve group including the first intake valve V1, the first exhaust valve V2, the second intake valve V3, the second exhaust valve V4, and the pressure equalizing valve V5.

Ina case where the valve portion 72 is the rotary valve, the valve portion 72 is provided with a rotor valve resin member (hereinafter, simply referred to as a valve rotor) and a stator valve metal member (hereinafter, simply referred to as a valve stator). That is, the valve rotor is formed of a resin material (for example, an engineering plastic material, a fluororesin material), and the valve stator is formed of a metal (for example, an aluminum material or an iron material). Conversely, the valve rotor may be formed of metal and the valve stator may be formed of resin.

Both valve stator and valve rotor are located in the low pressure gas chamber 60. The valve stator is fixed to the housing 52. The valve rotor is rotatably supported by the housing 52 via a bearing. The valve rotor is connected to the rotation output shaft 46 and rotates with respect to the valve stator by the rotation of the rotation drive source 44. The valve rotor and the valve stator may be referred to as a valve disk and a valve body, respectively.

Alternatively, the valve portion 72 may comprise a plurality of individually controllable control valves and a control unit for controlling the control valves.

The valve portion 72 is configured such that the pressure equalizing valve V5 is closed following opening of the first intake valve V1. A valve timing (for example, a rotation angle of the valve rotor with respect to the valve stator) from the opening of the first intake valve V1 to the closing of the pressure equalizing valve V5 is preferably in a range of 1° to 9°, more preferably in a range of 2° to 6°, still more preferably in a range of 3° to 5°, and still more preferably approximately 4°. Additionally or alternatively, the valve portion 72 is configured such that the pressure equalizing valve V5 is closed following opening of the second exhaust valve V4. A valve timing from the opening of the second exhaust valve V4 to the closing of the pressure equalizing valve V5 is preferably in a range of 1° to 9°, more preferably in a range of 2° to 6°, still more preferably in a range of 3° to 5°, and still more preferably approximately 4°.

The valve portion 72 is configured such that the pressure equalizing valve V5 is closed following opening of the first exhaust valve V2. A valve timing (for example, a rotation angle of the valve rotor with respect to the valve stator) from the opening of the first exhaust valve V2 to the closing of the pressure equalizing valve V5 is preferably in a range of 1° to 9°, more preferably in a range of 2° to 6°, still more preferably in a range of 3° to 5°, and still more preferably approximately 4°. Additionally or alternatively, the valve portion 72 is configured such that the pressure equalizing valve V5 is closed following opening of the second intake valve V3. A valve timing from the opening of the second intake valve V3 to the closing of the pressure equalizing valve V5 is preferably in a range of 1° to 9°, more preferably in a range of 2° to 6°, still more preferably in a range of 3° to 5°, and still more preferably approximately 4°.

As shown in FIG. 2, the first intake valve V1 is configured so as to determine a first intake period A1 of the first cold head 14*a*. In addition, as shown in FIG. 1, the first intake valve V1 is disposed in a first intake flow path 74*a* which connects the high pressure port 54 to the first room-temperature chamber 22*a* of the first cold head 14*a*. In the first intake period A1 (that is, when the first intake valve V1 opens), the working gas flows from the discharge port of the compressor 12 into the first room-temperature chamber 22*a*. Inversely, when the first intake valve V1 is closed, the supply of the working gas from the compressor 12 to the first room-temperature chamber 22*a* is stopped.

The first exhaust valve V2 is configured so as to determine a first exhaust period A2 of the first cold head 14*a*. The first exhaust valve V2 is disposed in a first exhaust flow path 76*a* which connects the low pressure port 56 to the first room-temperature chamber 22*a* of the first cold head 14*a*. In the first exhaust period A2 (that is, when the first exhaust valve V2 opens), the working gas flows from the first room-temperature chamber 22*a* into the suction port of the compressor 12. When the first exhaust valve V2 is closed, the recovery of the working gas from the first room-temperature chamber 22*a* to the compressor 12 is stopped. As shown in FIG. 1, a portion of the first exhaust flow path 76*a* and the first intake flow path 74*a* may share each other on the first room-temperature chamber 22*a* side.

Similarly, the second intake valve V3 is configured so as to determine a second intake period A3 of the second cold head 14*b*. The second intake valve V3 is disposed in a second intake flow path 74*b* which connects the high pressure port 54 to the second room-temperature chamber 22*b* of the second cold head 14*b*. In the second intake period A3 (that is, when the second intake valve V3 opens), the working gas flows from the discharge port of the compressor 12 into the second room-temperature chamber 22*b*. When the second intake valve V3 is closed, the supply of the working gas from the compressor 12 to the second room-temperature chamber 22*b* is stopped. As shown in FIG. 1, a portion of the second intake flow path 74*b* and the first intake flow path 74*a* may share each other on the compressor 12 side.

The second exhaust valve V4 is configured so as to determine a second exhaust period A4 of the second cold head 14*b*. The second exhaust valve V4 is disposed in a second exhaust flow path 76*b* which connects the low pressure port 56 to the second room-temperature chamber 22*b* of the second cold head 14*b*. In the second exhaust period A4 (that is, when the second exhaust valve V4 opens), the working gas flows from the second room-temperature chamber 22*b* to the suction port of the compressor 12. When the second exhaust valve V4 is closed, the recovery of the working gas from the second room-temperature chamber 22*b* to the compressor 12 is stopped. As shown in FIG. 1, a portion of the second exhaust flow path 76*b* and the second intake flow path 74*b* may share each other on the second room-temperature chamber 22*b* side. Moreover, a portion of the second exhaust flow path 76*b* and the first exhaust flow path 76*a* may share each other on the compressor 12 side.

The pressure equalizing valve V5 is configured to determine a first pressure equalization period B1 and a second pressure equalization period B2. The pressure equalizing valve V5 is disposed in a bypass flow path 58 which communicates with the first room-temperature chamber 22*a* and the second room-temperature chamber 22*b*. The bypass flow path 58 connects the first intake flow path 74*a* to the second exhaust flow path 76*b* and connects the second intake flow path 74*b* to the first exhaust flow path 76*a*. Connection points between other flow paths and the bypass flow path 58 are positioned between the intake and exhaust valves (that is, the first intake valve V1, the first exhaust valve V2, the second intake valve V3, and the second exhaust valve V4) and a room-temperature chambers (that is, the first room-temperature chamber 22*a* and the second room-temperature chamber 22*b*). Accordingly, the pressure equalizing valve V5 can directly connect the first gas chamber of the first cold head 14*a* and the second gas chamber of the second cold head 14*b* regardless of opening and closing of the intake and exhaust valves.

Although it is described in detail later, when the first pressure equalization period B1 starts, the pressure of the first gas chamber of the first cold head 14*a* is low and the pressure of the second gas chamber of the second cold head 14*b* is high. Accordingly, in the first pressure equalization period B1 (that is, when the pressure equalizing valve V5 is opened), the working gas flows from the second room-temperature chamber 22*b* to the first room-temperature chamber 22*a*. Inversely, when the second pressure equalization period B2 starts, the pressure of the first cold head 14*a* is high and the pressure of the second cold head 14*b* is low. Accordingly, in the second pressure equalization period B2 (that is, when the pressure equalizing valve V5 is opened), the working gas flows from the first room-temperature chamber 22*a* to the second room-temperature chamber 22*b*. The pressure equalization between the first cold head 14*a* and the second cold head 14*b* is performed by the opening of the pressure equalizing valve V5. When the pressure equalizing valve V5 is closed, there is no direct gas flow between the first room-temperature chamber 22*a* and the second room-temperature chamber 22*b*.

In FIG. 2, the first intake period A1, the first exhaust period A2, the second intake period A3, the second exhaust period A4, the first pressure equalization period B1, and the second pressure equalization period B2 are exemplified. The first intake period A1 and the first exhaust period A2 alternate with each other, and the second intake period A3 and the second exhaust period A4 alternate with each other. In addition, the first pressure equalization period B1 and the second pressure equalization period B2. The periods indicate periods during which the corresponding valves are opened. That is, in FIG. 2, the valves are opened at periods indicated by solid lines and the valves are closed at periods indicated by dashed lines.

In FIG. 2, one period of the axial reciprocation of the displacer connector 16 is represented in association with 360°, and thus, 0° is a start point of the period and 360° is an end point of the period. 90°, 180°, and 270° correspond to a ¼ period, a half period, a ¾ period, respectively. The first (second) displacer 16*a* (16*b*) is positioned at or near the bottom (top) dead center at 0°, and the first (second) displacer 16*a* (16*b*) is positioned at or near the top (bottom) dead center at 180°.

The first pressure equalization period B1 starts at a first timing t1 and ends at a third timing t3. In the shown example, the first timing t1 is 0° and the third timing t3 is 90°.

The first intake period A1 and the second exhaust period A4 start at a second timing t2 and end at a fourth timing t4. Compared to the third timing t3, the second timing t2 preferably precedes 1° to 9°, more preferably precedes 2° to 6°, still more preferably precedes 3° to 5°, and still more preferably precedes approximately 4°. In the shown example, a start timing of the first intake period A1 and a start timing of the second exhaust period A4 coincide with each other, but may be different from each other.

As the shown example, an end timing of the second exhaust period A4 may be inconsistent with a start timing (and/or the end timing of the first intake period A1) of the second pressure equalization period B2. In addition, the end timing of the first intake period A1 may be inconsistent with the start timing of the second pressure equalization period B2. An end timing (and/or the end timing of the first intake period A1) of the second exhaust period A4 may slightly precede (for example, 1° to 9°) the start timing of the second pressure equalization period B2.

The second pressure equalization period B2 starts at a fourth timing t4 and ends at a sixth timing t6. In the shown example, the fourth timing t4 is 180° and the sixth timing is 270°.

The first exhaust period A2 and the second intake period A3 start at a fifth timing t5 and end at a seventh timing t7. Compared to the sixth timing t6, the fifth timing t5 preferably precedes 1° to 9°, more preferably precedes 2° to 6°, still more preferably precedes 3° to 5°, and still more preferably precedes approximately 4°. In the shown example, a start timing of the first exhaust period A2 and a start timing of the second intake period A3 coincide with each other, but may be different from each other.

As the shown example, an end timing of the first exhaust period A4 may be inconsistent with a start timing (and/or the end timing of the second intake period A3) of the first pressure equalization period B1. In addition, the end timing of the second intake period A3 may be inconsistent with the start timing of the first pressure equalization period B2. An end timing (and/or the end timing of the second intake period A3) of the first exhaust period A2 may slightly precede (for example, 1° to 9°) the start timing of the first pressure equalization period B1.

Figure 3:
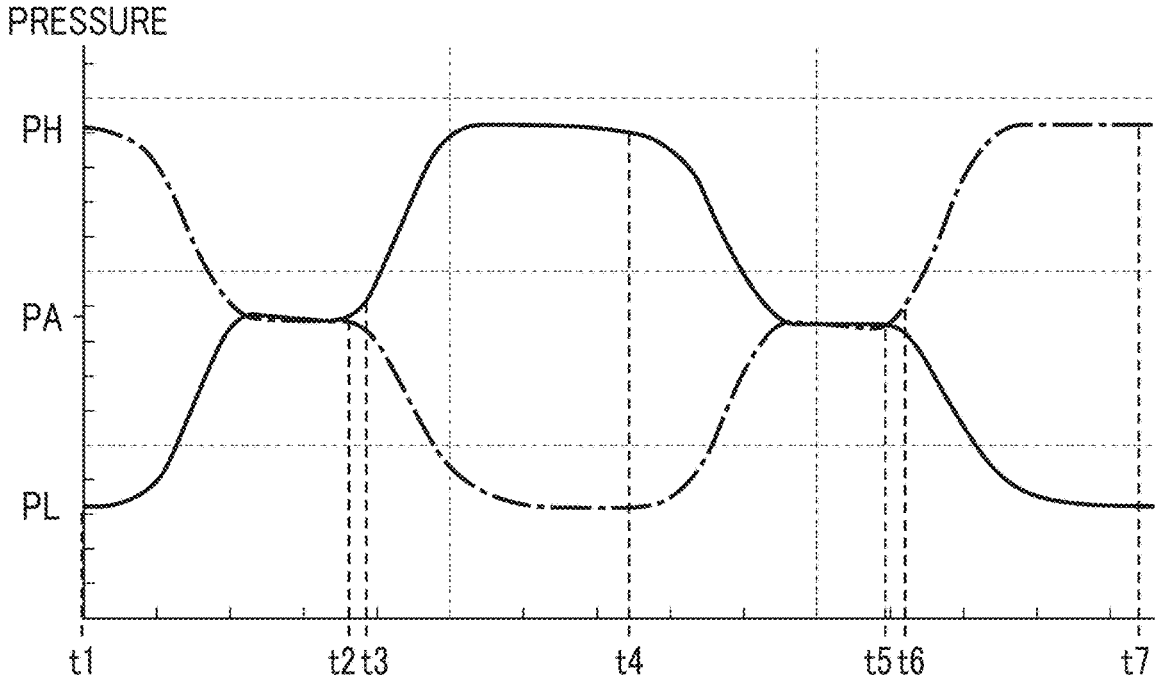
FIG. 3 is a graph exemplifying a pressure fluctuation of each of a first cold head and a second cold head when the GM cryocooler is operated at the valve timing shown in FIG. 2.

FIG. 3 is a graph exemplifying a pressure fluctuation of each of the first cold head 14*a* and the second cold head 14*b* when the GM cryocooler 10 is operated at the valve timing shown in FIG. 2. In FIG. 3, the pressure of the first cold head 14*a* is indicated by solid lines, and the pressure of the second cold head 14*b* is indicated by dash-dotted lines. The pressure fluctuation shown in FIG. 3 is a measurement result in a case where the first pressure equalization period B1 overlaps the first intake period A1 (and the second exhaust period A4) by approximately 4°, and the second pressure equalization period B2 overlap the first exhaust period A2 (and the second intake period A3) by approximately 4°.

With reference to FIGS. 1 to 3, an operation of the GM cryocooler 10 having the above-described configuration will be described. At the first timing t1, the pressure equalizing valve V5 is opened and the first pressure equalization period B1 starts. The first pressure equalization period B1 is next to the first exhaust period A2 and the second intake period A3. Accordingly, when the first pressure equalization period B1 starts, the pressure of the working gas in the first cold head 14*a* is a low pressure PL, and the pressure of the working gas in the second cold head 14*b* is a high pressure PH.

Accordingly, the working gas is supplied from the second cold head 14*b* to the first cold head 14*a* at the first pressure equalization period B1. In addition, the gas expands in the second expansion chamber 20*b* of the second cold head 14*b* and is cooled. The expanded gas is discharged from the second cold head 14*b* via the second room-temperature chamber 22*b* while cooling the second regenerator 26*b*. The gas flows from the second cold head 14*b* to the first cold head 14*a* via the bypass flow path 58 and the pressure equalizing valve V5. The first displacer 16*a* and the second displacer 16*b* move upward, and thus, a volume of the second expansion chamber 20*b* decreases while a volume of the first expansion chamber 20*a* increases. The pressure in the second cold head 14*b* decreases and the pressure in the first cold head 14*a* increases. In this way, the pressure equalization between the two cold heads is performed, and thus, an average pressure PA is obtained.

Continuously, at the second timing t2, the first intake valve V1 is opened and the first intake period A1 starts. Simultaneously, the second exhaust valve V4 is opened and the second exhaust period A4 starts. At the third timing t3 immediately after the second timing t2, the pressure equalizing valve V5 is closed and the first pressure equalization period B1 ends. The first intake period A1 and the second exhaust period A4 overlap the first pressure equalization period B1 from the second timing t2 to the third timing t3.

The first intake valve V1 is opened, and thus, a high pressure gas is supplied from the compressor 12 to the first room-temperature chamber 22*a* of the first cold head 14*a*, and the pressure in the first cold head 14*a* increases the average pressure PA to the high pressure PH. The inflow gas is cooled while passing through the first regenerator 26*a* and enters the first expansion chamber 20*a*. While the gas flows into the first cold head 14*a*, the first displacer 16*a* moves to the top dead center. In this way, at the fourth timing t4, the first intake valve V1 is closed and the first intake period A1 ends. The volume of the first expansion chamber 20*a* is maximized and the first expansion chamber 20*a* is filled with a high pressure gas.

In addition, the second exhaust valve V4 is opened, and thus, the pressure in the second cold head 14*b* decreases from the average pressure PA to the low pressure PL. The gas is expanded in the second expansion chamber 20*b* and is cooled. The expanded gas is recovered to the compressor 12 via the second room-temperature chamber 22*b* while cooling the second regenerator 26*b*. During this, the second displacer 16*b* moves to the bottom dead center. Immediately before the fourth timing t4, the second exhaust valve V4 is closed and the second exhaust period A4 ends. The volume of the second expansion chamber 20*b* is minimized.

At the fourth timing t4, the pressure equalizing valve V5 is opened and the second pressure equalization period B2 starts. In this case, the pressure of the working gas in the first cold head 14*a* is the high pressure PH, and the pressure of the working gas of the second cold head 14*b* is the low pressure PL.

Accordingly, in the second pressure equalization period B2, the working gas is supplied from the first cold head 14*a* to the second cold head 14*b*. In addition, the gas is expanded in the first expansion chamber 20*a* and cooled. The expanded gas is discharged from the first cold head 14*a* via the first room-temperature chamber 22*a* while cooling the first regenerator 26*a*. The gas flows from the first cold head 14*a* to the second cold head 14*b* through the bypass flow path 58 and the pressure equalizing valve V5. The first displacer 16*a* and the second displacer 16*b* move downward, and thus, the volume of the second expansion chamber 20*b* increases while the volume of the first expansion chamber 20*a* decreases. The pressure of the first cold head 14*a* decreases, and the pressure of the second cold head 14*b* increases. In this way, the pressure equalization between the two cold heads is performed.

Continuously, at the fifth timing t5, the first exhaust valve V2 is opened and the first exhaust period A2 starts. Simultaneously, the second intake valve V3 is opened and the second intake period A3 starts. At the sixth timing t6 immediately after the fifth timing t5, the pressure equalizing valve V5 is closed and the second pressure equalization period B2 ends. The first exhaust period A2 and the second intake period A3 overlap the second pressure equalization period B2 from the fifth timing t5 to the sixth timing t6.

The first exhaust valve V2 is opened, and the first pressure in the first cold head 14*a* decreases from the average pressure PA to the low pressure PL. The gas is expanded in the first expansion chamber 20*a* and is cooled. The expanded gas is recovered to the compressor 12 via the first room-temperature chamber 22*a* while cooling the first regenerator 26*a*. During this, the first displacer 16*a* moves to the bottom dead center. At the seventh timing, the first exhaust valve V2 is closed and the first exhaust period A2 ends. The volume of the first expansion chamber 20*a* is minimized.

In addition, the second intake valve V3 is opened, the high pressure gas is supplied from the compressor 12 to the second room-temperature chamber 22*b*, and the pressure of the second cold head 14*b* increases from the average pressure PA to the high pressure PH. The inflow gas is cooled while passing through the second regenerator 26*b*, and enters the second expansion chamber 20*b*. While the gas flows into the second cold head 14*b*, the second displacer 16*b* moves to the top dead center. In this way, the second intake valve V3 is closed and the second intake period A3 ends immediately after the seventh timing t7. The volume of the second expansion chamber 20*b* is maximized and the second expansion chamber 20*b* is filled with the high pressure gas.

After this, the first pressure equalization period B1 starts, and the above-described intake and exhaust step is repeated.

In the GM cryocooler 10, the cooling cycle (that is, GM cycle) is repeated, and thus, the first cooling stage 24*a* and the second cooling stage 24*b* can be cooled to an extremely desired low temperature.

The valve timing including the above-described pressure equalization step is adopted, and thus, one of the two cold heads can be used as a gas supply source of the other. The intake and exhaust are alternately performed on the two cold heads, and thus, a PV work is recovered, and it is possible to improve efficiency of the GM cryocooler 10.

In addition, the valve timing including the above-described overlap period (that is, the second timing t2 to the third timing t3 and the fifth timing t5 to the sixth timing t6) is adopted, and thus, it is possible to improve the cooling capacity of the GM cryocooler 10.

Figure 4:
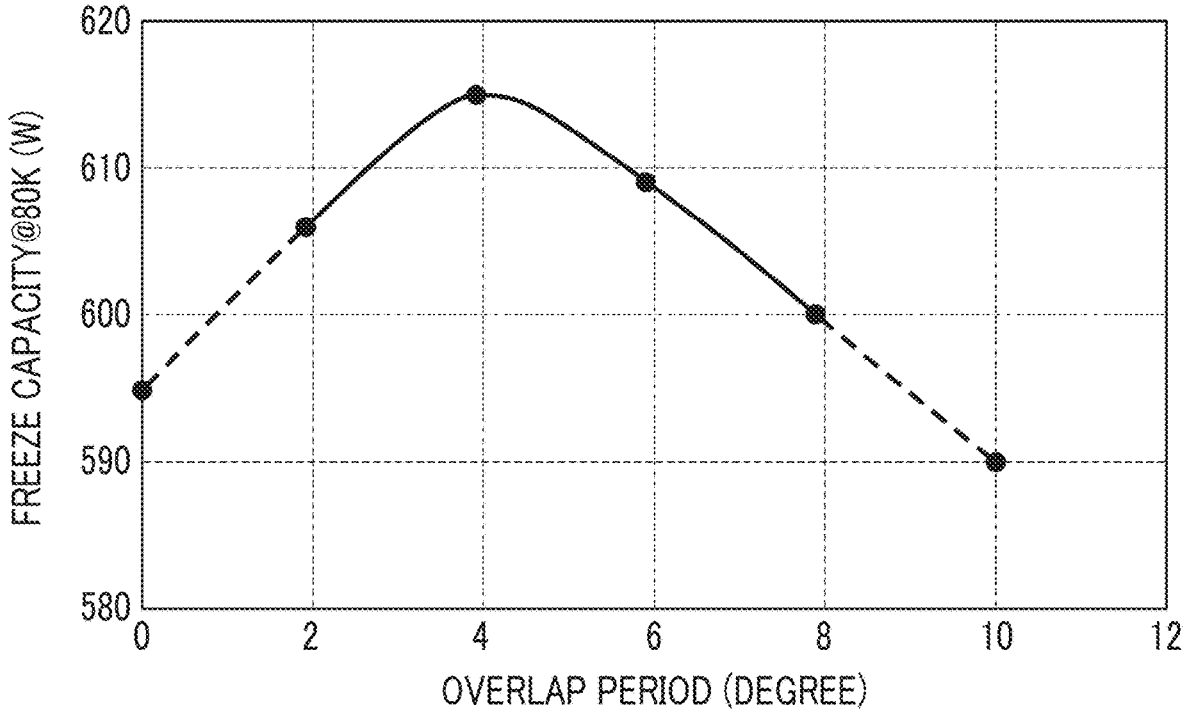
FIG. 4 is a graph showing a relationship between cooling capacity and an overlap period according to the GM cryocooler according to the embodiment.

FIG. 4 is a graph showing a relationship between the cooling capacity and the overlap period according to the GM cryocooler 10 according to the embodiment. A vertical axis of FIG. 4 indicates the cooling capacity at 80K. A horizontal axis of FIG. 4 indicates a first overlap period between the first pressure equalization period B1 and the second exhaust period A4. When the graph of FIG. 4 is obtained, a second overlap period between the second pressure equalization period B2 and the first exhaust period A2 is the same as the first overlap period. In addition, the overlap period between the first pressure equalization period B1 and the first intake period A1 is set to approximately 4°, and the overlap period between the second pressure equalization period B2 and the second intake period A3 is set to approximately 4°. In FIG. 4, a solid line indicates an experiment result and dashed lines indicate a reasonable estimated value of the inventor based on the experiment result.

As shown in FIG. 4, it is understood that the cooling capacity of the GM cryocooler 10 exhibits a unimodal change with a maximum value in a certain first overlap period. Specifically, the cooling capacity at 80K of GM cryocooler 10 reaches the maximum value of approximately 615 W when the first overlap period and the second overlap period are approximately 4°. On the other hand, when there is no overlap (that is, the overlap period is 0°), the estimated value of the cooling capacity is approximately 595 W. Moreover, in a case where the overlap is large (for example, 10°), the estimated value of the cooling capacity is approximately 590 W.

According to an inventor's consideration, it is not essential that both the intake period and the exhaust period overlap a pressure equalization period in order to obtain advantages in the improvement of the cooling capacity. Even if only one of the intake period or the exhaust period overlaps the pressure equalization period, the cooling capacity is improved. Accordingly, for example, the valve portion 72 of the GM cryocooler 10 may be configured such that the pressure equalizing valve V5 is closed following the opening of the first intake valve V1 and the second exhaust valve V4 is opened simultaneously with or following the closing of the pressure equalizing valve V5. In addition, the valve portion 72 may also be configured such that the pressure equalizing valve V5 is closed following the opening of the second exhaust valve V4 and the first intake valve V1 is opened simultaneously with or following the closing of the pressure equalizing valve V5. The same applies to the opening and closing timings of the first exhaust valve V2, the second intake valve V3, and the pressure equalizing valve V5.

Accordingly, preferably, the first overlap period (and/or the second overlap period) is in a range of 1° to 9°. Accordingly, in a case where there is no overlapping, it is possible to improve the cooling capacity of the GM cryocooler 10. In addition, compared to a case where there is an excessive overlap, it is possible to improve the cooling capacity of the GM cryocooler 10. The first overlap period (and/or the second overlap period) is preferably in a range of 2° to 6°, more preferably in a range of 3° to 5°, and still more preferably approximately 4°.

Meanwhile, in the expander of the GM cryocooler, there is a technology referred to as so-called "gas assist" using a gas pressure in order to decrease the drive torque. Typical gas assist is realized by distributing a portion of the supplied working gas to a gas assist chamber inside the expander separated from the expansion space. The working gas supplied to the gas assist chamber cannot contribute to the PV work in the expansion space. Accordingly, in the gas assist, there is a disadvantage that a decrease in the PV work may occur, that is, a decrease in freezing capacity may occur.

However, in the above-described embodiment, the first intake period A1 overlaps the second exhaust period A4. Accordingly, when the gas is supplied from the compressor 12 to the first cold head 14*a*, the gas is recovered from the second cold head 14*b* to the compressor 12. In this case, the pressure of the first expansion chamber 20*a* is higher than the pressure of the second expansion chamber 20*b*, and thus, this pressure difference biases the displacer connector 16 upward in the FIG. 1. Since a direction of a biasing force coincides with the movement direction of the displacer connector 16, it is possible to assist the common drive mechanism 40 by the pressure difference.

In addition, since the first exhaust period A2 overlaps the second intake period A3, when the gas is recovered from the first cold head 14*a*, the gas is supplied to the second cold head 14*b*, and the pressure of the first expansion chamber 20*a* is lower than the pressure of the second expansion chamber 20*b*. This pressure difference biases the displacer connector 16 downward in FIG. 1. Accordingly, similarly to the first intake period A1, in the first exhaust period A2, it is possible to assist the common drive mechanism 40 by the pressure difference.

Accordingly, operations of the first cold head 14*a* and the second cold head 14*b* themselves provide the gas assist to the displacer connector 16. As in the above-described typical gas assist configuration, the working gas is not consumed in the dedicated gas assist chamber, and thus, a loss of the PV work does not occur. Therefore, it is possible to decrease the drive torque generated by the common drive mechanism 40 to drive the displacer connector 16, and thus, a size of the drive mechanism can decreases.

Alternatively, it is possible to drive the displacer connector 16 by only the pressure difference between the two cold heads.

In order to obtain the above-described advantages, the first intake period A1 and the second exhaust period A4 may not correctly coincide with each other. The second exhaust period A4 may at least partially overlap the first intake period A1. Similarly, the first exhaust period A2 and the second intake period A3 may not correctly coincide with each other. The second intake period A3 may at least partially overlap the first exhaust period A2.

In the above-described embodiment, the second intake period A3 does not overlap the first intake period A1. In addition, the second exhaust period A4 does not overlap the first exhaust period A2. In this way, the intake and exhaust timing from the compressor 12 to the first cold head 14*a* are completely deviated from the intake and exhaust timing from the compressor 12 to the second cold head 14*b*. Accordingly, a fluctuation between a high pressure and a low pressure of the compressor 12 decreases, and thus, it is possible to improve efficiency of the compressor 12.

In order to obtain the advantages, the intake and exhaust timings of the two cold heads need not be completely deviated from each other. Preferably, the second intake period A3 may be later than first intake period A1 by 150° or more. Along with this, or instead of this, preferably, the second exhaust period A4 may be later than the first exhaust period A2 by 150° or more.

In addition, lengths of the first intake period A1 and the second exhaust period A4 may be different from each other. Similarly, lengths of the first exhaust period A2 and the second intake period A3 may be different from each other. For example, the difference between the intake period and the exhaust period may be within 20° or 5°. In this way, the difference between freezing capacities of the first cold head 14*a* and the second cold head 14*b* may be adjusted.

In addition, the lengths of the first intake period A1 and the first exhaust period A2 may be different from each other. Similarly, the lengths of the second intake period A3 and the second exhaust period A4 may be different from each other. In this case, for example, the difference between the intake period and the exhaust period may be within 20° or 5°.

Moreover, in the above-described embodiment, since the GM cryocooler 10 is installed such that the two cold heads disposed to face each other are positioned in the longitudinal direction, it is possible to reduce the area of floor for installation of the GM cryocooler 10.

As described above, in the embodiment, the valve portion 72 may be configured as the rotary valve. A configuration of an exemplary rotary valve for realizing the valve timing including the above-described overlap period is described as follows.

Figure 5A:
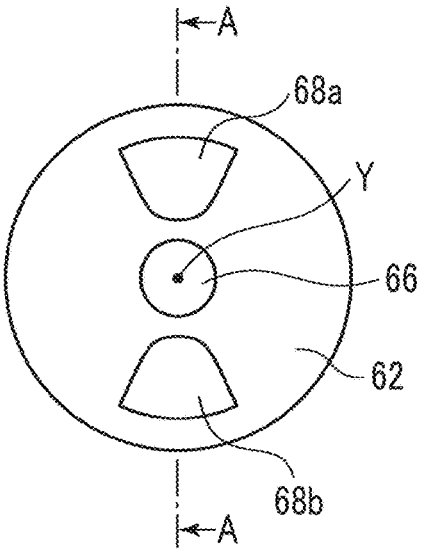
FIGS. 5A and 5B are schematic plan views respectively showing a valve stator and a valve rotor of a valve portion according to the embodiment.
Figure 5B:
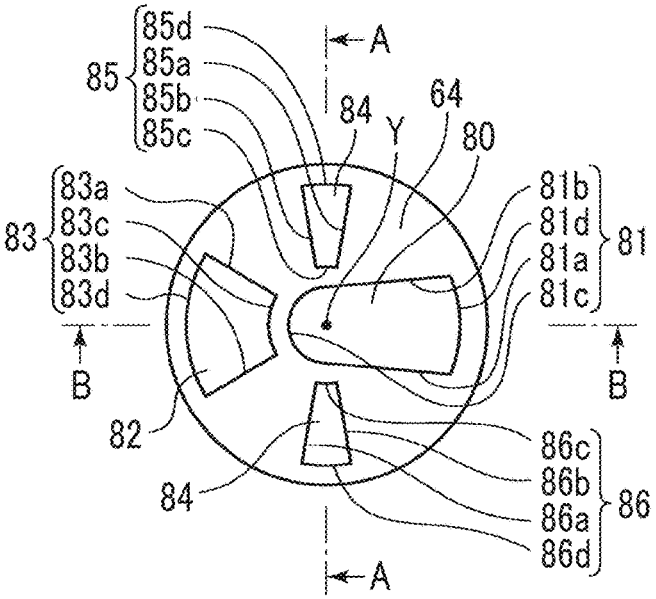
Figure 6:
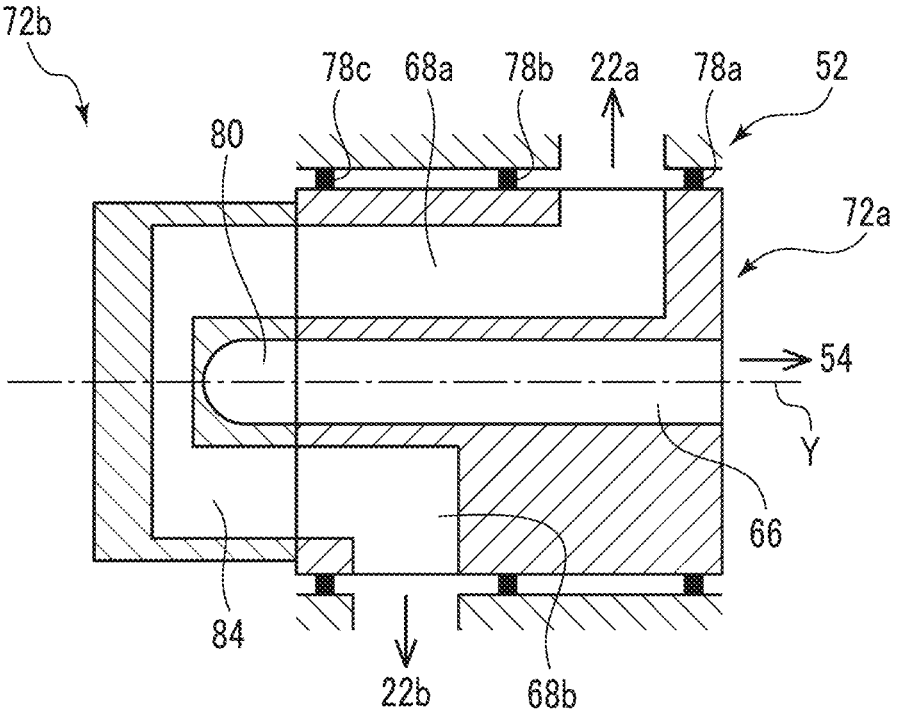
FIG. 6 is a sectional view taken along line A-A of the valve portion shown in FIGS. 5A and 5B.
Figure 7:
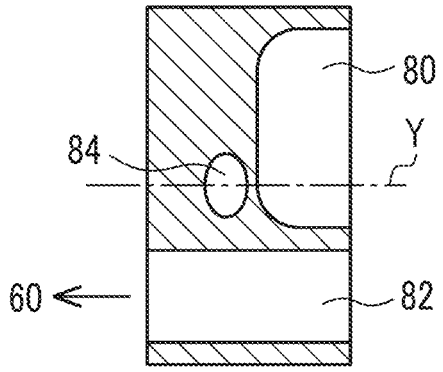
FIG. 7 is a sectional view taken along line B-B of the valve rotor shown in FIG. 5B.

FIGS. 5A and 5B are schematic plan views respectively showing a valve stator 72*a* and a valve rotor 72*b* of the valve portion 72 according to the embodiment. FIG. 6 is a sectional view taken along line A-A of the valve portion 72 shown in FIGS. 5A and 5B, and FIG. 7 is a sectional view taken along line B-B of the valve rotor 72*b* shown in FIG. 5B. Dashed-dotted lines shown in FIGS. 6 and 7 indicate a valve rotation axis Y.

The valve stator 72*a* includes a stator plane 62 perpendicular to the valve rotation axis Y, and similarly, the valve rotor 72*b* includes a rotor plane 64 perpendicular to the valve rotation axis Y. The valve rotor 72*b* can rotate around the valve rotation axis Y with respect to the valve stator 72*a*. When the valve rotor 72*b* rotates with respect to the valve stator 72*a*, the rotor plane 64 rotationally slides on the stator plane 62. The stator plane 62 and the rotor plane 64 are in surface-contact with each other, and thus, the leakage of the refrigerant gas is prevented.

The valve stator 72*a* includes a high pressure gas inflow 66, a first stator flow path 68*a*, and a second stator flow path 68*b*. The high pressure gas inlet 66 is open at a center portion of the stator plane 62 and is formed to penetrate the center portion of the valve stator 72*a* in a rotation axis direction. The high pressure gas inlet 66 defines a circular contour centered on the valve rotation axis Y on the stator plane 62. The high pressure gas inlet 66 communicates with the high pressure port 54 shown in FIG. 1.

The first stator flow path 68*a* and the second stator flow path 68*b* are open on sides opposite to each other with respect to the high pressure gas inlet 66 on the stator plane 62. Accordingly, the first stator flow path 68*a* and the second stator flow path 68*b* are positioned radially outside the high pressure gas inlet 66. The first stator flow path 68*a* and the second stator flow path 68*b* define a fan-shaped contour centered on the valve rotation axis Y on the stator plane 62. Therefore, each of the first stator flow path 68*a* and the second stator flow path 68*b* has an arcuate outer edge line on the radially outside of the stator plane 62.

As shown in FIG. 6, the first stator flow path 68*a* and the second stator flow path 68*b* extend from the stator plane 62 in the valve stator 72*a* in the rotation axis direction, are bent midway, and are open on the cylindrical side surface of the valve stator 72*a*. In this way, the first stator flow path 68*a* and the second stator flow path 68*b* penetrate the valve stator 72*a*. The first stator flow path 68*a* communicates with the first room-temperature chamber 22*a* shown in FIG. 1 through a flow path formed in the housing 52. The second stator flow path 68*b* communicates with the second room-temperature chamber 22*b* shown in FIG. 1 through another flow path formed in the housing 52.

The first stator flow path 68*a* has a length different from the second stator flow path 68*b* in the axial direction and the length of the first stator flow path 68*a* is longer than that of the second stator flow path 68*b* in the shown example. This is for sealing the first stator flow path 68*a* and the second stator flow path 68*b*.

FIG. 6 schematically shows a seal structure between the valve stator 72*a* and the housing 52. As shown in FIG. 6, a first seal member 78*a*, a second seal member 78*b*, and a third seal member 78*c* are provided in a clearance between the valve stator 72*a* and the housing 52. For example, these seal members are annular seal members such as O-rings, and extend in the circumferential direction along a side surface of the valve stator 72*a*. The first stator flow path 68*a* are open between the first and second seal members 78*a* and 78*b* and the second stator flow path 68*b* are open between the second seal member 78*b* and the third seal member 78*c*. Therefore, the first room-temperature chamber 22*a* and the second room-temperature chamber 22*b* can be sealed to each other by cooperation of the rotary operation of the valve portion 72 and the seal structure.

As shown in FIG. 5B, the valve rotor 72*b* includes a high pressure flow path 80, a low pressure flow path 82, and a pressure equalization flow path 84 which are open to the rotor plane 64. The rotor plane 64 are in surface contact with the stator plane 62 around these flow paths.

The high pressure flow path 80, the low pressure flow path 82, and the pressure equalization flow path 84 are circumferentially arranged around the valve rotation axis Y on the rotor plane 64. In other words, the high pressure flow path 80, the low pressure flow path 82, and the pressure equalization flow path 84 are arranged in an annular region surrounding the valve rotation axis Y about the valve rotation axis Y on the rotor plane 64. When the valve portion 72 is assembled, the first stator flow path 68*a* and the second stator flow path 68*b* of the valve stator 72*a* are similarly arranged in this annular region. However, as will be described later, a radially inner portion of the high pressure flow path 80 extends from the annular region to the valve rotation axis Y.

Therefore, when the valve rotor 72*b* rotates around the valve rotation axis Y, connections between the three flow paths (that is, the high pressure gas inlet 66, the first stator flow path 68*a*, and the second stator flow path 68*b*) of the valve stator 72*a* and the three flow paths (that is, the high pressure flow path 80, the low pressure flow path 82, and the pressure equalization flow path 84) of the valve rotor 72*b* are switched periodically. Accordingly, the valve portion 72 operates as the above-described valve group (that is, the first intake valve V1, the first exhaust valve V2, the second intake valve V3, the second exhaust valve V4, and the pressure equalizing valve V5).

The high pressure flow path 80 is a recessed portion which is formed in the valve rotor 72*b*, and a depth of the high pressure flow path 80 from the rotor plane 64 is shorter than a length of the valve rotor 72*b* in the rotation axis direction. Accordingly, the high pressure flow path 80 does not penetrate the valve rotor 72*b*. The high pressure flow path 80 extends over the radially outer side from a center portion of the rotor plane 64. As described above, the high pressure gas inlet 66 of the valve stator 72*a* is a center portion of the stator plane 62, and thus, the high pressure flow path 80 always communicates with the high pressure gas inlet 66 of the valve stator 72*a*.

The high pressure flow path 80 defines a fan-shaped high pressure flow path contour 81 on the rotor plane 64. The high pressure flow path contour 81 includes a high pressure flow path front edge line 81*a*, a high pressure flow path rear edge line 81*b*, a high pressure flow path inner edge line 81*c*, and a high pressure flow path outer edge line 81*d*. The high pressure flow path front edge line 81*a* and the high pressure flow path rear edge line 81*b* are positioned to be separated from each other in a valve rotation direction (that is, a circumferential direction around the valve rotation axis Y), and the high pressure flow path inner edge line 81*c* and the high pressure flow path outer edge line 81*d* are positioned to be separated from each other in a valve diameter direction. The high pressure flow path inner edge line 81*c* connects one end of the high pressure flow path front edge line 81*a* to one end of the high pressure flow path rear edge line 81*b*, and the high pressure flow path outer edge line 81*d* connects the other end of the high pressure flow path front edge line 81*a* to the other end of the high pressure flow path rear edge line 81*b*. Each of the high pressure flow path front edge line 81*a* and the high pressure flow path rear edge line 81*b* is linear.

Each of the high pressure flow path inner edge line 81*c* and the high pressure flow path outer edge line 81*d* is an arc centered on the valve rotation axis Y. A center angle of the high pressure flow path inner edge line 81*c* is positioned on a side opposite to a center angle of the high pressure flow path outer edge line 81*d* with respect to the valve rotation axis Y. The high pressure flow path inner edge line 81*c* is positioned radially inside the high pressure flow path outer edge line 81*d*, and a radius of the high pressure flow path inner edge line 81*c* is smaller than a radius of the high pressure flow path outer edge line 81*d*. The radius of the high pressure flow path inner edge line 81*c* is the same as a radius of a circular contour line of the high pressure gas inlet 66. The radius of the high pressure flow path outer edge line 81*d* is slightly smaller than a radius of the valve rotor 72*b* itself. In addition, the radius of the high pressure flow path outer edge line 81*d* is the same as the radius of the outer edge line of each of the first stator flow path 68*a* and the second stator flow path 68*b*.

The high pressure flow path 80 is formed in the valve rotor 72*b* such that the high pressure gas inlet 66 communicates with the first stator flow path 68*a* in a portion (for example, the first intake period A1) of one period in the rotation of the valve rotor 72*b* and the high pressure gas inlet 66 communicates with the second stator flow path 68*b* in another portion (for example, the second intake period A3) of the one period. In addition, the high pressure flow path 80 is formed in the valve rotor 72*b* such that both the first stator flow path 68*a* and the second stator flow path 68*b* do not communicate with the high pressure gas inlet 66 in a remaining portion of the one period.

In this way, the first intake valve V1 which defines the first intake period A1 and the second intake valve V3 which defines the second intake period A3 constitute the valve portion 72. The high pressure flow path 80 forms a portion of the first intake valve V1 and is a portion of the second intake valve V3.

The low pressure flow path 82 is open on a side opposite to the high pressure flow path 80 in the radial direction on the rotor plane 64. The low pressure flow path 82 is formed to penetrate the valve rotor 72*b* in the rotation axis direction, and communicates with the low pressure gas chamber 60 (or low pressure port 56) shown in FIG. 1.

The low pressure flow path 82 defines a fan-shaped low pressure flow path contour 83 on the rotor plane 64. The low pressure flow path contour 83 includes a low pressure flow path front edge line 83*a*, a low pressure flow path rear edge line 83*b*, a low pressure flow path inner edge line 83*c*, and a low pressure flow path outer edge line 83*d*. The low pressure flow path front edge line 83*a* and the low pressure flow path rear edge line 83*b* are positioned to be separated from each other in the valve rotation direction, and the low pressure flow path inner edge line 83*c* and the low pressure flow path outer edge line 83*d* are positioned to be separated from each other in the valve diameter direction. The low pressure flow path inner edge line 83*c* connects one end of the low pressure flow path front edge line 83*a* to one end of the low pressure flow path rear edge line 83*b*, and the low pressure flow path outer edge line 83*d* connects the other end of the low pressure flow path front edge line 83*a* to the other end of the low pressure flow path rear edge line 83*b*.

Each of the low pressure flow path front edge line 83*a* and the low pressure flow path rear edge line 83*b* is linear. Each of the low pressure flow path front edge line 83*a* and the low pressure flow path rear edge line 83*b* is formed on the rotor plane 64 along a radius centered on the valve rotation axis Y.

Each of the low pressure flow path inner edge line 83*c* and the low pressure flow path outer edge line 83*d* is an arc centered on the valve rotation axis Y and has the same center angle as each other. The low pressure flow path inner edge line 83*c* is positioned radially inside the low pressure flow path outer edge line 83*d*. That is, a radius of the low pressure flow path inner edge line 83*c* is smaller than a radius of the low pressure flow path outer edge line 83*d*. The radius of the low pressure flow path inner edge line 83*c* is slightly larger than the radius of the high pressure flow path inner edge line 81*c*. The radius of the low pressure flow path outer edge line 83*d* is the same as the radius of the high pressure flow path outer edge line 81*d*.

The low pressure flow path 82 is formed in the valve rotor 72*b* such that the low pressure gas chamber 60 communicates with the first stator flow path 68*a* in a portion (for example, the first exhaust period A2) of one period in the rotation of the valve rotor 72*b* and the low pressure gas chamber 60 communicates with the second stator flow path 68*b* in another portion (for example, the second exhaust period A4) of the one period. In addition, the low pressure flow path 82 is formed in the valve rotor 72*b* such that both the first stator flow path 68*a* and the second stator flow path 68*b* do not communicate with the low pressure gas chamber 60 in a remaining portion of the one period.

In this way, the first exhaust valve V2 which defines the first exhaust period A2 and the second exhaust valve V4 which defines the second exhaust period A4 constitute the valve portion 72. The low pressure flow path 82 forms a portion of the first exhaust valve V2 and is a portion of the second exhaust valve V4.

Each of the pressure equalization flow paths 84 is a hollow portion which extends inside the valve rotor 72*b* in the valve diameter direction. The pressure equalization flow path 84 is separated from the high pressure flow path 80 and the low pressure flow path 82 and is not connected to these.

The pressure equalization flow path 84 defines a fan-shaped first pressure equalization flow path contour 85 and a fan-shaped second pressure equalization flow path contour 86 on the rotor plane 64. The first pressure equalization flow path contour 85 is positioned between the high pressure flow path 80 and the low pressure flow path 82 in the circumferential direction around the valve rotation axis Y on the rotor plane 64. The second pressure equalization flow path contour 86 is positioned between the high pressure flow path 80 and the low pressure flow path 82 in the circumferential direction around the valve rotation axis Y on the rotor plane 64. However, the second pressure equalization flow path contour 86 is positioned on a side opposite to the first pressure equalization flow path contour 85 on the rotor plane 64. The first pressure equalization flow path contour 85 and the second pressure equalization flow path contour 86 have the same fan shape, and have center angles which are smaller than the center angle of the low pressure flow path contour 83 (that is, is narrower than the low pressure flow path contour 83).

The first pressure equalization flow path contour 85 includes a first pressure equalization flow path front edge line 85*a*, a first pressure equalization flow path rear edge line 85*b*, a first pressure equalization flow path inner edge line 85*c*, and a first pressure equalization flow path outer edge line 85*d*. The first pressure equalization flow path front edge line 85*a* and the first pressure equalization flow path rear edge line 85*b* are positioned to be separated from each other in the valve rotation direction, and the first pressure equalization flow path inner edge line 85*c* and the first pressure equalization flow path outer edge line 85*d* are positioned to be separated from each other in the valve diameter direction. The first pressure equalization flow path inner edge line 85*c* connects one end of the first pressure equalization flow path front edge line 85*a* to one end of the first pressure equalization flow path rear edge line 85*b*, and the first pressure equalization flow path outer edge line 85*d* connects the other end of the first pressure equalization flow path front edge line 85*a* to the other end of the first pressure equalization flow path rear edge line 85*b*.

Each of the first pressure equalization flow path front edge line 85*a* and the first pressure equalization flow path rear edge line 85*b* is linear. Each of the first pressure equalization flow path front edge line 85*a* and the first pressure equalization flow path rear edge line 85*b* is formed on the rotor plane 64 along a radius centered on the valve rotation axis Y.

Each of the first pressure equalization flow path inner edge line 85*c* and the first pressure equalization flow path outer edge line 85*d* is an arc centered on the valve rotation axis Y and has the same center angle as each other. The first low pressure flow path inner edge line 85*c* is positioned radially inside the first low pressure flow path outer edge line 85*d*. That is, a radius of the first pressure equalization flow path inner edge line 85*c* is smaller than a radius of the first pressure equalization flow path outer edge line 85*d*. The radius of the first pressure equalization flow path inner edge line 85*c* is the same as the radius of the low pressure flow path inner edge line 83*c*. The radius of the first pressure equalization flow path outer edge line 85*d* is the same as the radius of each of the high pressure flow path outer edge line 81*d* and the low pressure flow path outer edge line 83*d*.

Similarly to the first pressure equalization flow path contour 85, the second pressure equalization flow path contour 86 also includes a second pressure equalization flow path front edge line 86*a*, a second pressure equalization flow path rear edge line 86*b*, a second pressure equalization flow path inner edge line 86*c*, and a second pressure equalization flow path outer edge line 86*d*.

The pressure equalization flow path 84 is formed in the valve rotor 72*b* such that the first stator flow path 68*a* communicates with the second stator flow path 68*b* in a portion (for example, the first pressure equalization period B1 and the second pressure equalization period B2) of one period in the rotation of the valve rotor 72*b* and the first stator flow path 68*a* and the second stator flow path 68*b* do not communicate with each other in the remaining portion of the one period.

In this way, the pressure equalizing valve V5 defining the first pressure equalization period B1 and the second pressure equalization period B2 constitutes the valve portion 72. The pressure equalization flow path 84 constitutes a portion of the pressure equalizing valve V5.

Figure 8:
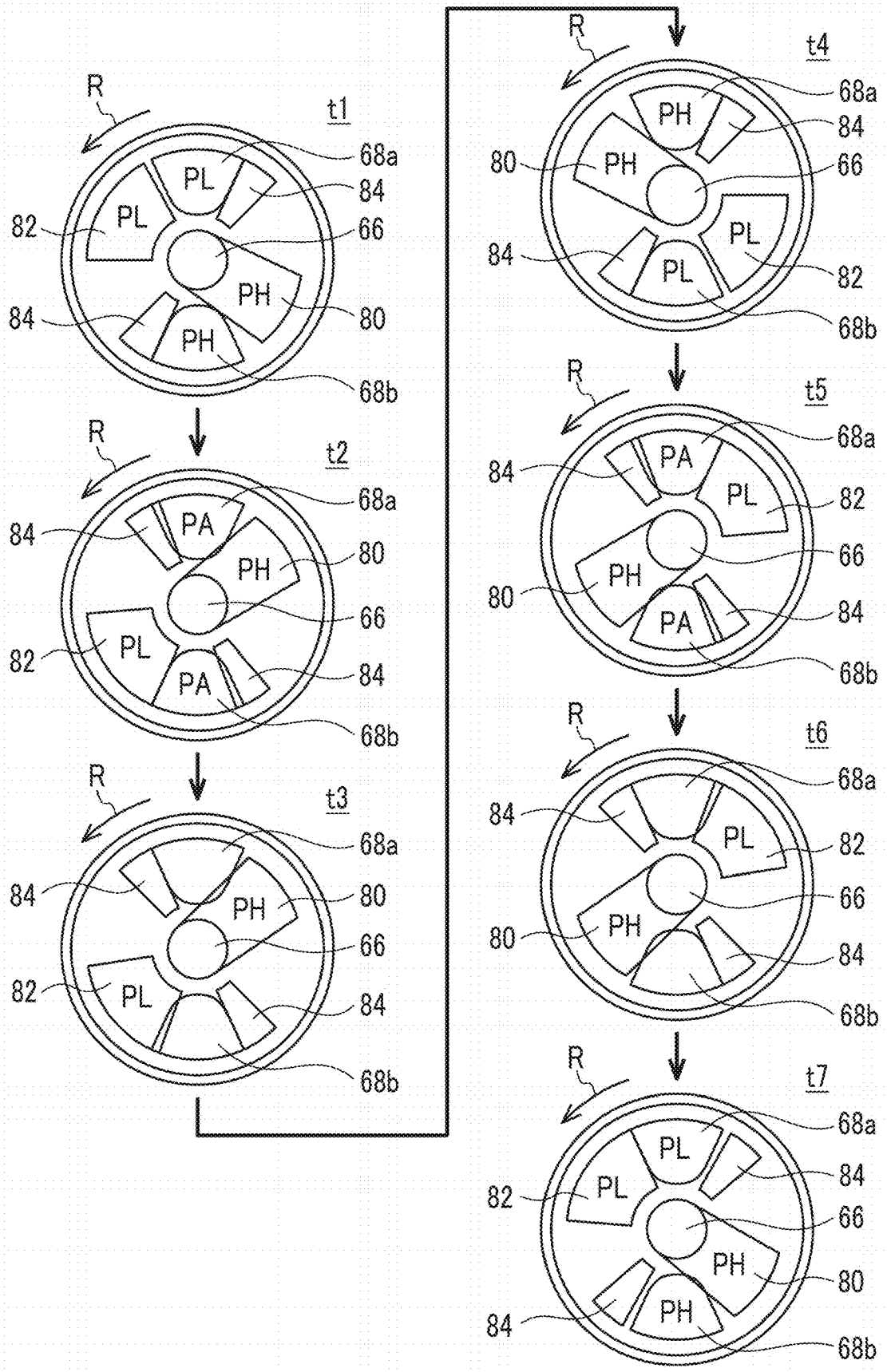
FIG. 8 is a view exemplifying an operation of the valve portion according to the embodiment.
Figure 9:
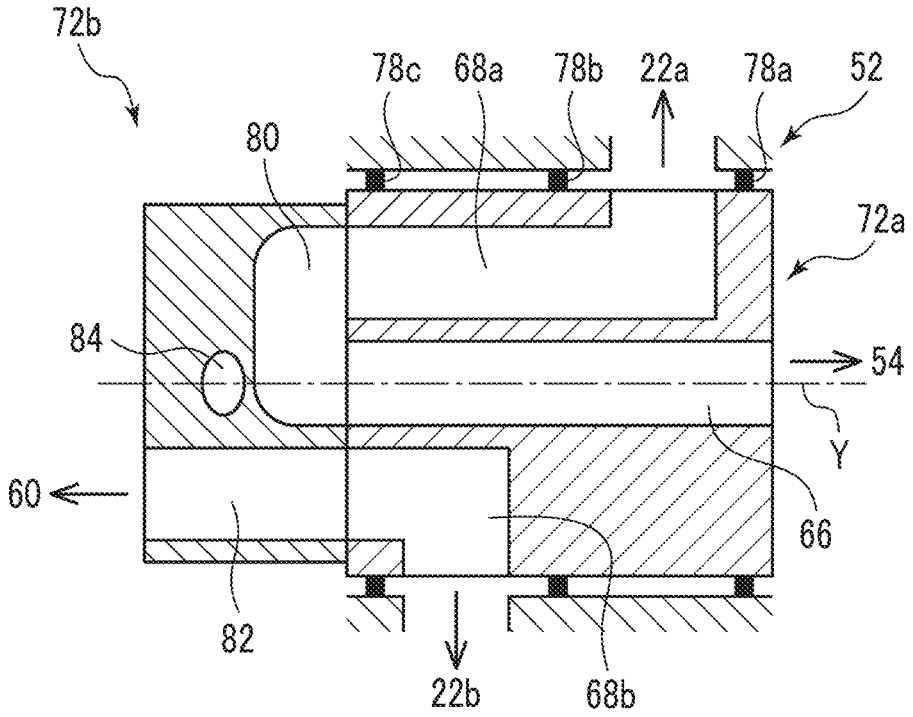
FIG. 9 is a view schematically showing a flow path connection of the valve portion in intake and exhaust steps.

FIG. 8 is a view exemplifying an operation of the valve portion 72 according to the embodiment. In FIG. 8, a flow path connection in the valve portion 72 is shown in association with the valve timing shown in FIG. 2. A valve rotation direction R is shown. The pressure of the high pressure flow path 80 is the high pressure PH and the pressure of the low pressure flow path 82 is the low pressure PL. FIG. 9 is a view schematically showing the flow path connection of the valve portion 72 in intake and exhaust steps.

As described above, at the first timing t1, the pressure equalizing valve V5 is opened and the first pressure equalization period B1 starts. When the first pressure equalization period B1 starts, the pressure of the first stator flow path 68*a* is the low pressure PL similar to the first cold head 14*a*, and the pressure of the second stator flow path 68*b* is the high pressure PH similar to the second cold head 14*b*. The pressure equalization flow path 84 reaches the first stator flow path 68*a* and the second stator flow path 68*b* by the rotation of the valve rotor 72*b*. Accordingly, as shown in FIG. 6, the first room-temperature chamber 22*a* communicates with the second room-temperature chamber 22*b* through the pressure equalization flow path 84. In this way, as described above, the working gas is supplied from the second cold head 14*b* to the first cold head 14*a*. The pressure equalization between the two cold heads is performed, and thus, the average pressure PA is obtained.

Subsequently, at the second timing t2, the first intake valve V1 is opened and the first intake period A1 starts. Simultaneously, the second exhaust valve V4 are opened and the second exhaust period A4 starts. The high pressure flow path 80 reaches the first stator flow path 68*a* and the low pressure flow path 82 reaches the second stator flow path 68*b* by the rotation of the valve rotor 72*b*. As shown in FIG. 9, the high pressure port 54 communicates with the first room-temperature chamber 22*a* through the high pressure flow path 80. In addition, the low pressure gas chamber 60 communicates with the second room-temperature chamber 22*b* through the low pressure flow path 82. The working gas is supplied from the compressor 12 to the first cold head 14*a* and the working gas is recovered from the second cold head 14*b* to the compressor 12. The pressure in the first cold head 14*a* increases from the average pressure PA to the high pressure PH and the pressure in the second cold head 14*b* decreases from the average pressure PA to the low pressure PL.

As described above, the period from the second timing t2 to the third timing t3 is the overlap period in which the first pressure equalization period B1 is continued, and thus, as shown in the drawings, the pressure equalization flow path 84 overlaps the first stator flow path 68*a* and the second stator flow path 68*b*. At the third timing t3, the pressure equalizing valve V5 is closed and the first pressure equalization period B1 starts. The pressure equalization flow path 84 passes through the first stator flow path 68*a* and the second stator flow path 68*b*.

Thereafter, the high pressure flow path 80 passes through the first stator flow path 68*a* until the fourth timing t4, and the low pressure flow path 82 passes through the second stator flow path 68*b*. In this way, the first intake period A1 and the second exhaust period A4 end.

At the fourth timing t4, the pressure equalizing valve V5 is opened and the second pressure equalization period B2 starts. Similarly to the first timing t1, the pressure equalization flow path 84 reaches the first stator flow path 68*a* and the second stator flow path 68*b* by the rotation of the valve rotor 72*b*. The first room-temperature chamber 22*a* communicates with the second room-temperature chamber 22*b* through the pressure equalization flow path 84. The working gas is supplied from the first cold head 14*a* to the second cold head 14*b*. The pressure equalization between the two cold heads is performed.

Subsequently, at the fifth timing 5, the first exhaust valve V2 is opened and the first exhaust period A2 starts. Simultaneously, the second intake valve V3 is opened and the second intake period A3 starts. The high pressure flow path 80 reaches the second stator flow path 68*b* and the low pressure flow path 82 reaches the first stator flow path 68*a* by the rotation of the valve rotor 72*b*. The high pressure port 54 communicates with the second room-temperature chamber 22*b* through the high pressure flow path 80 and the working gas is supplied from the compressor 12 to the second cold head 14*b*. The low pressure gas chamber 60 communicates with the first room-temperature chamber 22*a* through the low pressure flow path 82 and the working gas is returned from the first cold head 14*a* to the compressor 12. The pressure in the first cold head 14*a* decreases from the average pressure PA to the low pressure PL. The pressure in the second cold head 14*b* increases from the average pressure PA to the high pressure PH.

As described above, the period from the fifth timing t5 to the sixth timing t6 is the overlap period in which the second pressure equalization period B2 is continued, and thus, as shown in the drawings, the pressure equalization flow path 84 overlaps the first stator flow path 68*a* and the second stator flow path 68*b*. At the sixth timing t6, the pressure equalizing valve V5 is closed and the first pressure equalization period B1 ends. The pressure equalization flow path 84 passes through the first stator flow path 68*a* and the second stator flow path 68*b*.

Thereafter, at the seventh timing t7, the low pressure flow path 82 passes through the first stator flow path 68*a* and the first exhaust period A2 ends. The high pressure flow path 80 passes through the second stator flow path 68*b* until the next first timing t1, and the second intake period A3 ends.

As described above, the high pressure flow path 80, the low pressure flow path 82, and the pressure equalization flow path 84 of the valve rotor 72*b* are circumferentially arranged around the valve rotation axis Y on the rotor plane 64. The pressure equalization flow paths 84 are disposed between the high pressure flow path 80 and the low pressure flow path 82 in the circumferential direction around the valve rotation axis Y on the rotor plane 64. Accordingly, compared to a case where the pressure equalization flow paths 84 are disposed at radial positions different from that of the high pressure flow path 80 and/or the low pressure flow path 82 on the rotor plane 64, it is possible to decrease the diameter of the valve rotor 72*b*. Therefore, decreases in sizes of the valve portion 72 and a drive mechanism (for example, common drive mechanism 40) thereof can be realized, which is preferable.

The valve timing including the above-described overlap period (that is, the second timing t2 to the third timing t3 and the fifth timing t5 to the sixth timing t6) is adopted, it is possible to widen the high pressure flow path 80 and/or the low pressure flow path 82 in the circumferential direction around the valve rotation axis Y. It is possible to prolong the intake period and/the exhaust period, and thus, a flow path pressure loss decreases. Therefore, it is possible to improve cooling capacity of the GM cryocooler 10.

In the valve rotor 72*b*, the high pressure flow path outer edge line 81*d*, the low pressure flow path outer edge line 83*d*, the first pressure equalization flow path outer edge line 85*d*, and the second pressure equalization flow path outer edge line 86*d* are positioned on the same circumference. In addition, the low pressure flow path inner edge line 83*c*, the first pressure equalization flow path inner edge line 85*c*, and the second pressure equalization flow path inner edge line 86*c* are positioned on the same circumference. Accordingly, it is possible to increase radial dimensions of the high pressure flow path contour 81, the low pressure flow path contour 83, the first pressure equalization flow path contour 85, and the second pressure equalization flow path contour 86 while relatively decreasing the diameter of the valve rotor 72*b*. It is possible to relatively increase a flow path area. This also decreases the flow path pressure loss.

It should be understood that the invention is not limited to the above-described embodiment, but may be modified into various forms on the basis of the spirit of the invention. Additionally, the modifications are included in the scope of the invention.

The positions and/or the shapes of the high pressure flow path 80, the low pressure flow path 82, and the pressure equalization flow path 84 are not limited to the shown example, and other positions and/or shapes can be adopted. In addition, the positions and/or the shapes of the high pressure gas inlet 66, the first stator flow path 68*a*, and the second stator flow path 68*b* are not limited to the shown example, and other positions and/or shapes can be adopted.

The second cold head 14*b* may not be disposed to face the first cold head 14*a*. For example, the second cold head 14*b* may be disposed in parallel with the first cold head 14*a*.

The present invention can be used in a field of A Gifford-McMahon (GM) cryocooler.

What is claimed is:

1. A GM cryocooler comprising:

a valve rotor that comprises:

a high pressure flow path, the high pressure flow path is disposed in the valve rotor and opens to a rotor plane of the valve rotor, a low pressure flow path, the low pressure flow path is disposed in the valve rotor and opens to the rotor plane of the valve rotor, and a pressure equalization flow path, the pressure equalization flow path is disposed in the valve rotor and opens to the rotor plane of the valve rotor; and a valve group that comprises:

a first intake valve that is configured to intake a working gas into a first gas chamber, the high pressure flow path is a portion of the first intake valve, a first exhaust valve that is configured to exhaust the working gas from within the first gas chamber, the low pressure flow path is a portion of the first exhaust valve, a second intake valve that is configured to intake the working gas into a second gas chamber, the high pressure flow path is a portion of the second intake valve, a second exhaust valve that is configured to exhaust the working gas from within the second gas chamber, the low pressure flow path is a portion of the second exhaust valve, and a pressure equalizing valve that is configured to perform pressure equalization between the first gas chamber and the second gas chamber, the pressure equalization flow path is a portion of the pressure equalizing valve, wherein:

the high pressure flow path is configured to always be physically connected to a discharge port of a compressor, the low pressure flow path is configured to always be physically connected to a suction port of the compressor and to be open on a side opposite to the high pressure flow path in a radial direction on the rotor plane, the pressure equalization flow path is a hollow portion which extends inside the valve rotor in a valve radial direction, and defines a first pressure equalization flow path contour and a second pressure equalization flow path contour on the rotor plane, the first pressure equalization flow path contour is positioned between the high pressure flow path and the low pressure flow path in a circumferential direction around a valve rotation axis on the rotor plane, the second pressure equalization flow path contour is positioned between the high pressure flow path and the low pressure flow path in the circumferential direction around the valve rotation axis on the rotor plane, and the second pressure equalization flow path contour is positioned on a side opposite to the first pressure equalization flow path contour on the rotor plane.

2. The GM cryocooler according to claim 1, wherein the pressure equalizing valve is closeable after the first intake valve opens.

3. The GM cryocooler according to claim 1, wherein a rotation angle of the valve rotor from opening the first intake valve to closing the pressure equalizing valve is in a range of 1° to 9°.

4. The GM cryocooler according to claim 1, wherein a rotation angle of the valve rotor from opening the first exhaust valve to closing the pressure equalizing valve is in a range of 1° to 9°.

5. The GM cryocooler according to claim 1, further comprising:

a valve stator that comprises:

a high pressure gas inlet which is open at a center portion of a stator plane, a first stator flow path configured to communicate with the first gas chamber, and a second stator flow path configured to communicate with the second gas chamber, wherein the first stator flow path and the second stator flow path are open on sides opposite to each other with respect to the high pressure gas inlet on the stator plane.

6. The GM cryocooler according to claim 1, wherein the pressure equalization flow path is separated from the high pressure flow path and the low pressure flow path.

7. The GM cryocooler according to claim 5, wherein the valve rotor is configured to rotate with respect to the valve stator.

8. The GM cryocooler according to claim 5, wherein the stator plane is in surface contact with the rotor plane.

9. The GM cryocooler according to claim 5, wherein the high pressure flow path, the low pressure flow path, and the pressure equalization flow path of the valve rotor are circumferentially arranged around the valve rotation axis on the rotor plane.

10. The GM cryocooler according to claim 9, wherein the rotor plane is rotatable around the valve rotation axis.

11. The GM cryocooler according to claim 9, wherein the rotor plane is perpendicular to the valve rotation axis, and the valve rotation axis is perpendicular to the stator plane.

12. The GM cryocooler according to claim 5, wherein the high pressure flow path is formed in the valve rotor such that the high pressure gas inlet communicates with the first stator flow path in a portion of one period in a rotation of the valve rotor and the high pressure gas inlet communicates with the second stator flow path in another portion of the one period, and the high pressure flow path is formed in the valve rotor such that both the first stator flow path and the second stator flow path do not communicate with the high pressure gas inlet in a remaining portion of the one period.

13. The GM cryocooler according to claim 5, wherein the low pressure flow path is formed in the valve rotor such that the suction port of the compressor communicates with the first stator flow path in a portion of one period in a rotation of the valve rotor and the suction port of the compressor communicates with the second stator flow path in another portion of the one period, and the low pressure flow path is formed in the valve rotor such that both the first stator flow path and the second stator flow path do not communicate with the suction port of the compressor in a remaining portion of the one period.

14. The GM cryocooler according to claim 5, wherein the pressure equalization flow path is formed in the valve rotor such that the first stator flow path communicates with the second stator flow path in a portion of one period in a rotation of the valve rotor, and the first stator flow path and the second stator flow path do not communicate with each other in a remaining portion of the one period.

15. The GM cryocooler according to claim 1, wherein the pressure equalizing valve is closeable after the second intake valve opens.

16. The GM cryocooler according to claim 1, further comprising:

a first cold head that comprises a first displacer and a first cylinder, the first gas chamber is disposed between the first displacer and the first cylinder; and a second cold head that comprises a second displacer and a second cylinder, the second gas chamber is disposed between the second displacer and the second cylinder.

17. The GM cryocooler according to claim 16, wherein the second displacer is disposed coaxially with the first displacer.

18. The GM cryocooler according to claim 16, wherein the second displacer is connected to the first displacer so as to axially reciprocate together with the first displacer.

* * * * *